US006320563B1

(12) United States Patent
Yang et al.

(10) Patent No.: US 6,320,563 B1
(45) Date of Patent: Nov. 20, 2001

(54) DUAL FREQUENCY CHOLESTERIC DISPLAY AND DRIVE SCHEME

(75) Inventors: Deng-Ke Yang, Hudson; Ming Xu, Kent, both of OH (US)

(73) Assignee: Kent State University, Kent, OH (US)

( * ) Notice: Subject to any disclaimer, the term of this patent is extended or adjusted under 35 U.S.C. 154(b) by 0 days.

(21) Appl. No.: 09/235,082

(22) Filed: Jan. 21, 1999

(51) Int. Cl.[7] ..... G09G 3/36

(52) U.S. Cl. ..... 345/87; 345/90; 345/94; 345/208; 349/86; 349/92; 349/93; 349/96

(58) Field of Search ..... 345/87, 89, 98, 345/94, 90, 208; 349/94, 36, 96, 86, 92, 93; 350/160

(56) References Cited

U.S. PATENT DOCUMENTS

| | | | | |
|---|---|---|---|---|
| 3,792,915 | | 2/1974 | Soo Oh et al. | 349/168 |
| 4,009,934 | * | 3/1977 | Goodwin et al. | 350/160 |
| 4,236,155 | | 11/1980 | Nagata | 349/170 |
| 4,317,115 | | 2/1982 | Kawakami et al. | 359/55 |
| 4,514,045 | | 4/1985 | Huffman et al. . | |
| 4,626,074 | | 12/1986 | Crossland et al. . | |
| 4,636,788 | | 1/1987 | Hilbrink . | |
| 4,641,135 | | 2/1987 | Hilbrink . | |
| 4,668,049 | | 5/1987 | Canter et al. . | |
| 4,705,345 | | 11/1987 | Ayliffe et al. . | |
| 4,728,175 | | 3/1988 | Baron . | |
| 4,761,058 | | 8/1988 | Okubo et al. . | |
| 4,769,639 | | 9/1988 | Kawamura et al. . | |
| 4,836,654 | | 6/1989 | Fujimura et al. | 349/170 |
| 4,864,538 | | 9/1989 | Buzak . | |
| 4,909,607 | | 3/1990 | Ross . | |
| 4,927,242 | | 5/1990 | Aoki et al. | 349/170 |
| 4,958,915 | | 9/1990 | Okada et al. . | |
| 5,036,317 | | 7/1991 | Buzak . | |
| 5,132,823 | | 7/1992 | Kamath et al. . | |
| 5,168,378 | | 12/1992 | Black et al. . | |
| 5,168,380 | | 12/1992 | Fergason . | |
| 5,189,535 | | 2/1993 | Mochizuki et al. | 359/55 |
| 5,251,048 | | 10/1993 | Doane et al. . | |
| 5,252,954 | | 10/1993 | Nagata et al. | 345/210 |
| 5,260,699 | | 11/1993 | Lister et al. . | |
| 5,280,280 | | 1/1994 | Hotto . | |
| 5,285,214 | | 2/1994 | Bowry . | |
| 5,289,175 | | 2/1994 | Kawagishi | 359/84 |
| 5,289,300 | | 2/1994 | Yamazaki et al. . | |
| 5,293,261 | | 3/1994 | Shashidhar et al. . | |
| 5,315,101 | | 5/1994 | Hughes et al. . | |
| 5,621,552 | | 4/1997 | Coates et al. | 349/86 |
| 5,877,826 | * | 3/1999 | Yang et al. | 349/36 |
| 5,952,991 | * | 9/1999 | Akiyama | 345/98 |
| 5,999,157 | * | 12/1999 | Ito et al. | 345/94 |
| 6,023,312 | * | 2/2000 | Hasegawa et al. | 349/88 |

OTHER PUBLICATIONS

Kozachenko et al., Hysteresis as a Key Factor for the Fast Control of Reflectivity in Cholesteric LCDs, 1997 SID, pp. 148–151.

Kawasumi, et al., "Novel memory effect found in nematic liquid crystal/fine particle system," Liquid Crystals, 1996, vol. 21, No. 6, pp. 769–776; Jul., 1996.

(List continued on next page.)

*Primary Examiner*—Richard Hjerpe
*Assistant Examiner*—Ali A. Zamani
(74) *Attorney, Agent, or Firm*—Renner, Kenner, Greive, Bobak, Taylor & Weber

(57) ABSTRACT

A dual frequency cholesteric display includes a pair of opposed substrates, wherein one of the substrates has a first plurality of electrodes facing a second plurality of electrodes on the other substrate. A dual frequency bistable cholesteric liquid crystal material is disposed between the substrates, wherein the material and the intersection of the first and second plurality of electrodes forms a plurality of pixels. By selectively applying high and low frequency voltages to the plurality of pixels, the high frequency voltage causes the material to exhibit one texture and the low frequency voltage causes the material to exhibit another texture. By adjusting a voltage amplitude value for each high and low frequency causes each pixel to exhibit a desired reflectance.

22 Claims, 3 Drawing Sheets

OTHER PUBLICATIONS

Hasegawa, et al., "Reversible electro–optical switching of a memory type PDLC using two–frequency–addressing liquid crystals," Liquid Crystals, 1996, vol. 21, No. 5, pp. 765–766; May, 1996.

Schadt, "Low–Frequency Dielectric Relaxations in Nematics and Dual–Frequency Addressing of Field Effects," Mol. Cryst. Liq. Cryst., 1982, vol. 89, pp. 77–92.

Schadt, "Effects of dielectric relaxations and dual–frequency addressing on the electro–optics of guest–host liquid crystal displays," Appl. Phys. Lett., vol. 41, No. 8, Oct. 15, 1982, pp. 697–699.

Bücher, et al., "Frequency–addressed liquid crystal field effect," Applied Physics Letters, vol. 25, No. 4, Aug. 15, 1974, pp. 186–188.

de Jeu, et al., "Nematic Phenyl Benzoates in Electric Fields I. Static and Dynamic Properties of the Dielectric Permittivity," Mol. Cryst. Liq. Cryst., vol. 26, pp. 225–234; Aug., 1972.

Stein, et al., "A Two–Frequency Coincidence Addressing Scheme for Nematic–Liquid–Crytal Displays," Applied Physcis Letters, vol. 19, No. 9, pp. 343–345, Nov. 1, 1971.

Wild, et al., "Turn–On Time Reduction and Contrast Enhancement in Matrix–Addressed Liquid Crystal Light Valves," Applied Physics Letters, vol. 19, No. 9, Nov. 1, 1971.

Meier and Saupe, "Dielectric Relaxation in Nematic Liquid Crystals," Molecular Crystals, vol. 1, pp. 515–525, 1966.

* cited by examiner

DUAL FREQUENCY CHOLESTERIC DISPLAY AND DRIVE SCHEME

GOVERNMENT GRANT

The United States Government has a paid-up license in this invention and may have the right in limited circumstances to require the patent owner to license others on reasonable terms as provided for by the terms of Grant DMR89-20147, awarded by the National Science Foundation.

TECHNICAL FIELD

The present invention relates generally to liquid crystal displays. More particularly, the present invention relates to cholesteric liquid crystal displays. Specifically, the present invention relates to a dual frequency cholesteric display and method of driving this display.

BACKGROUND ART

Liquid crystal displays take advantage of a liquid crystal's ability to reflect and scatter light. This light reflecting ability is in part due to liquid crystal's tendency to form textures. The term texture describes the molecular orientations within a liquid crystal display cell. Cholesteric liquid crystals exhibit three alignments. These are the planar texture, focal conic texture, and homeotropic texture. Cholesteric crystals exhibit a helical molecular structure. The helical structure is formed by stacked long molecules that are progressively displaced through a small angle. When these liquid crystals are in the focal conic texture, the individual helical domains are in a random arrangement. This random arrangement weakly scatters light. The helical axis is more or less parallel to the supporting surfaces. In the homeotropic texture, the liquid crystal material adopts a completely undeformed director configuration. In this configuration, the director points perpendicular to the supporting surfaces. Finally, in the planar texture, the helical axis is aligned perpendicular to the supporting surfaces. As the liquid crystal material moves from one of these textures to another, its light propagating attributes change.

Cholesteric liquid crystals are used for reflective displays because they exhibit Bragg reflection in the planar texture. In the focal conic texture, cholesteric liquid crystal material scatters light. They are both stable at zero field. For a regular cholesteric liquid crystal with a positive dielectric anisotropy, the transition from the planar texture to the focal conic texture is direct and is achieved by applying a low voltage pulse. However, the transition from the focal conic texture to the planar texture is indirect. The material must be switched from the focal conic texture to a third state, a homeotropic texture, by a high voltage pulse, and then the material relaxes to the planar texture. The need to switch the material to the homeotropic texture is disadvantageous because the voltage required to switch the material to homeotropic texture is high, response time is increased, and it is difficult to make use of cumulative effect with the homeotropic texture. These disadvantages make it impractical to use known cholesteric liquid crystals in video rate displays.

It is known to provide a dual frequency cholesteric liquid crystal material responsive to high and low frequency voltages. However, it is only known to apply a single high or low frequency of varying duration to change the appearance of the material. This results in a slow and unacceptable addressing speed.

Thus, it is desirable to develop a drive scheme for switching directly from the focal conic texture to the planar texture without first switching to a homeotropic texture. It is also desirable to provide a cholesteric display that would be conducive to video rate applications.

DISCLOSURE OF INVENTION

It is, therefore, a primary object of the present invention to provide a dual frequency cholesteric liquid crystal display and drive scheme.

It is another object of the present invention to provide a display and drive scheme, as above, to switch cholesteric liquid crystal material directly from a focal conic texture to a planar texture without first switching to a homeotropic texture.

It is a further object of the present invention to provide a display and drive scheme, as above, that switches a cholesteric liquid crystal by selectively applying multiple electric pulses.

It is still another object of the present invention to provide a drive scheme for a cholesteric liquid crystal display, as above, that simultaneously applies high and low frequency electric pulses.

It is an additional object of the present invention to provide a drive scheme for a cholesteric liquid crystal display, as above, wherein the liquid crystal material is switched cumulatively between the textures by multiple pulses so the amplitude or the duration of the pulses, or both, can be reduced.

The foregoing and other objects of the present invention, which shall become apparent as the detailed description proceeds, are achieved by a method of addressing a dual frequency cholesteric liquid crystal material disposed between opposed substrates, wherein one of the substrates has a first plurality of electrodes facing a second plurality of electrodes on the other substrate, and wherein the intersection of the first and the second plurality of electrodes forms a plurality of pixels, the method comprising the steps of selectively applying high and low frequency voltages to the plurality of pixels, wherein the high frequency voltage causes the material to exhibit one texture and the low frequency voltage causes the material to exhibit another texture, and adjusting a voltage amplitude value for each high and low frequency to obtain a desired reflectance for each pixel.

Other aspects of the present invention are attained by a dual frequency cholesteric display, comprising a pair of opposed substrates, wherein one of the substrates has a first plurality of electrodes facing a second plurality of electrodes on the other substrate, a dual frequency bistable cholesteric liquid crystal material disposed between the substrates, wherein the material and the intersection of the first and second plurality of electrodes forms a plurality of pixels, means for selectively applying high and low frequency voltages to the plurality of pixels, wherein the high frequency voltage causes the material to exhibit one texture and the low frequency voltage causes the material to exhibit another texture, and means for adjusting a voltage amplitude value for each high and low frequency to obtain a desired reflectance for each pixel.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
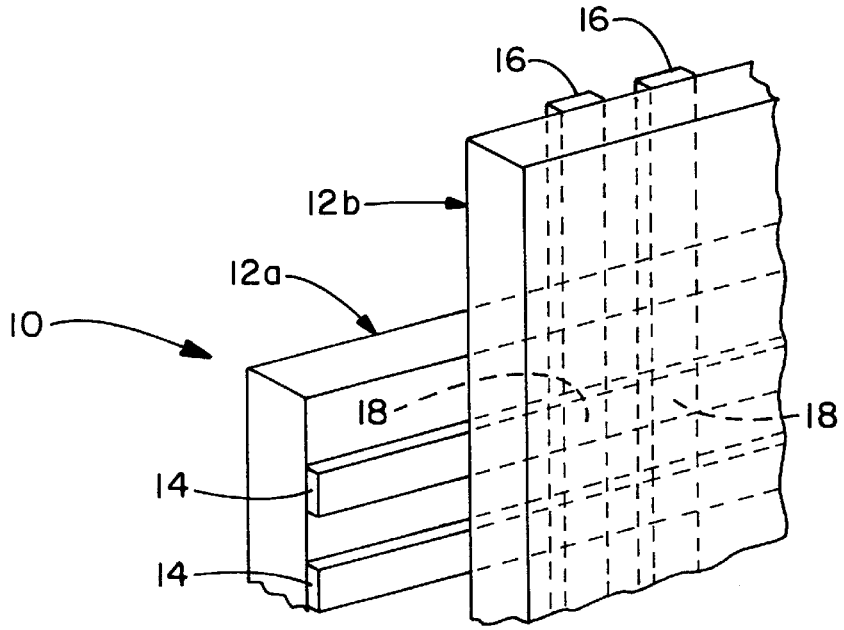
FIG. 1 is a perspective schematic representation of a liquid crystal display using row and column electrodes.

Referring now to the drawings and in particular to FIG. 1, it can be seen that a liquid crystal display, according to the present invention, is designated generally by the numeral 10. The display 10 includes opposed substrates 12*a* and 12*b* which may be either glass or plastic materials wherein at least one of the substrates is optically clear in appearance. In the preferred embodiment, a dual frequency bistable cholesteric liquid crystal material is disposed between the opposed substrates 12 in a manner well-known in the art. One of the opposed substrates 12*a* includes a plurality of row electrodes 14 facing the opposite substrate 12*b*. The other opposed substrate 12*b* provides a plurality of column electrodes 16 which face the opposed substrate 12*a*. By orthogonally orienting the electrodes 14 and 16, a plurality of picture elements or pixels 18 are formed at the intersections thereof over the entire surface of the liquid crystal display 10. Each of the pixels 18 may be individually addressed so as to generate indicia on the liquid crystal display 10. As will become apparent from the following description, each row electrode 14 and column electrode 16 is addressed by processor controlled electronics (not shown) to a range of voltage values that drive the cholesteric liquid crystal material to a desired reflectance or appearance.

Generally, the present invention is a dual frequency cholesteric display and a method of controlling the reflectance of the dual frequency cholesteric liquid crystal material in the display. In the preferred embodiment, the cholesteric liquid crystal material has a positive dielectric anisotropy when a low frequency voltage is applied and a negative dielectric anisotropy when a high frequency voltage is applied. The cross-over frequency, which is when the material switches between positive and negative anisotropies, is dependent upon the particular formulation of the material.

An example of a preferred cell has the following construction:

Mixture

2F333 (dual frequency nematic liquid crystal): 78.3 wt %

R1011 (chiral agent): 3.1 wt %

CE2 (chiral agent): 9.3 wt %

R811 (chiral agent): 9.3 wt %

The mixture was filled into a 5 microns thick cell with $SiO_x$ coating on top of the indium tin oxide (ITO) electrodes.

A method of control, or drive scheme, achieves direct transition of the material from a planar texture to a focal conic texture by applying a low frequency voltage to the electrodes. Likewise, direct transition from the focal conic texture to the planar texture is achieved by applying a high frequency voltage. Through its drive scheme, the dual frequency display takes advantage of the cholesteric liquid crystal's cumulative effect. In other words, switching between the planar texture and the focal conic texture is accomplished by applying multiple voltage pulses. This allows for reduced application of voltage or pulse duration to incrementally change the reflectance of the liquid crystal material. Accordingly, the drive scheme can be used to provide a quasi-video rate display.

The drive scheme controls the amount of reflection at each pixel by applying a voltage across the electrodes to the liquid crystal material. In particular, it controls the voltage's amplitude, frequency, and polarity. Controlling each of these variables at each electrode produces the desired reflectance at each selected pixel. The drive scheme is preferably implemented by a microprocessor or computer controlled system that can coordinate application of voltages and their frequencies to the electrodes in an efficient manner.

Figure 2:
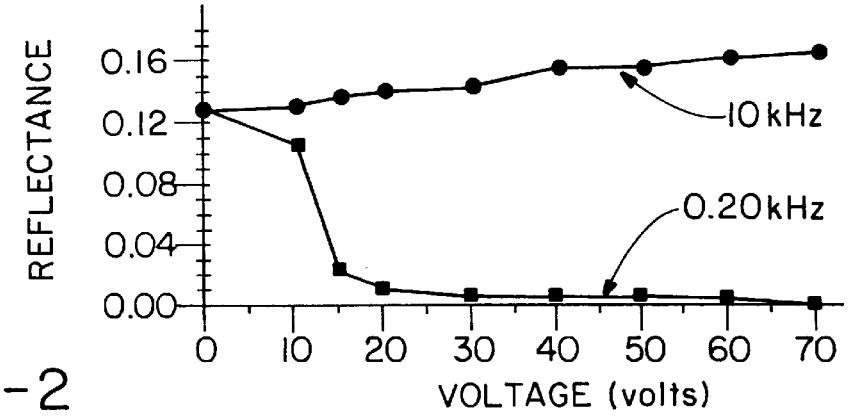
FIG. 2 is a graphical representation of the response to a continuously applied voltage pulse of a dual frequency cholesteric liquid crystal material initially in a planar texture.

As shown in FIG. 2, the drive scheme maintains the liquid crystal material initially in a planar texture by applying a continuous voltage with a high frequency of about 10 kHz. In FIG. 2, solid circles represent the high frequency voltage. By increasing the amplitude of the high frequency voltage, the drive scheme increases the material's reflectance. By applying a continuous voltage with a low frequency of about 200 Hz, shown as solid squares in FIG. 2, the liquid crystal material is driven to the focal conic texture and exhibits a low reflectance. Increasing the amplitude of the low frequency voltage, incrementally decreases the reflectance of the liquid crystal material.

Figure 3:
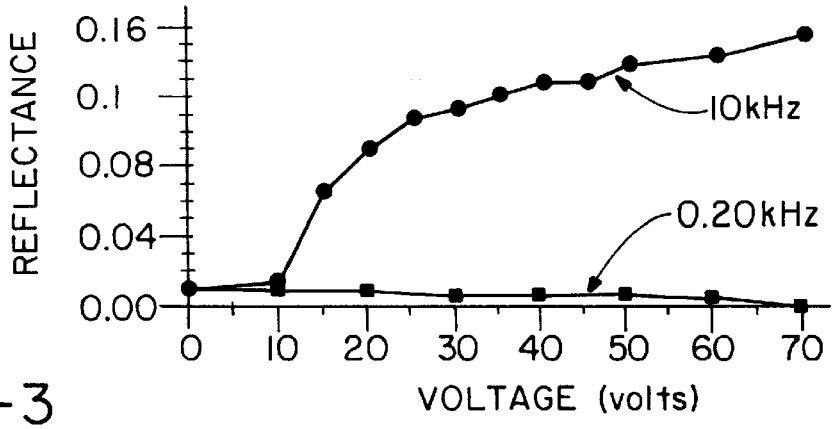
FIG. 3 is a graphical representation of the response to a continuously applied voltage pulse of a dual frequency cholesteric liquid crystal material initially in a focal conic texture.

As seen in FIG. 3, the dual frequency cholesteric liquid crystal material that is initially in a focal conic texture remains in that texture when a continuous low frequency voltage of about 200 Hz is applied. By increasing the amplitude of the low frequency voltage, the reflectance remains low. By applying a high frequency voltage of about 200 kHz, the liquid crystal material is driven to the planar texture. Increasing the amplitude of the high frequency voltage incrementally increases the reflectance of the liquid crystal material.

Figure 4:
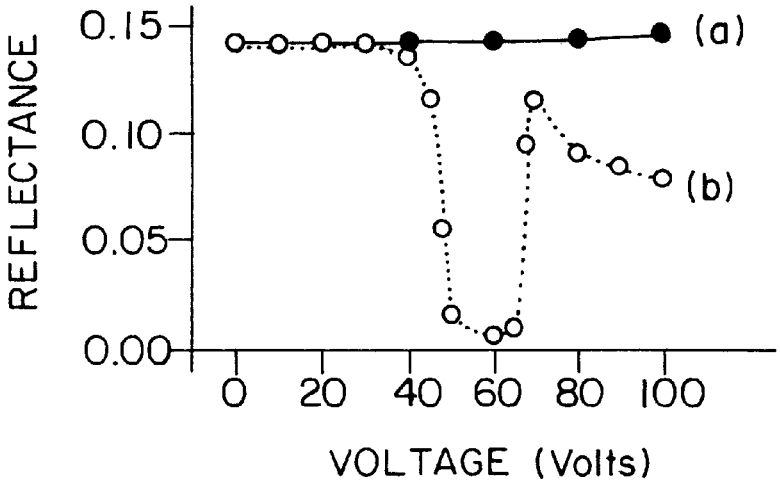
FIG. 4 is a graphical representation of the response to voltage pulses of a dual frequency cholesteric material initially in a planar texture.
Figure 5:
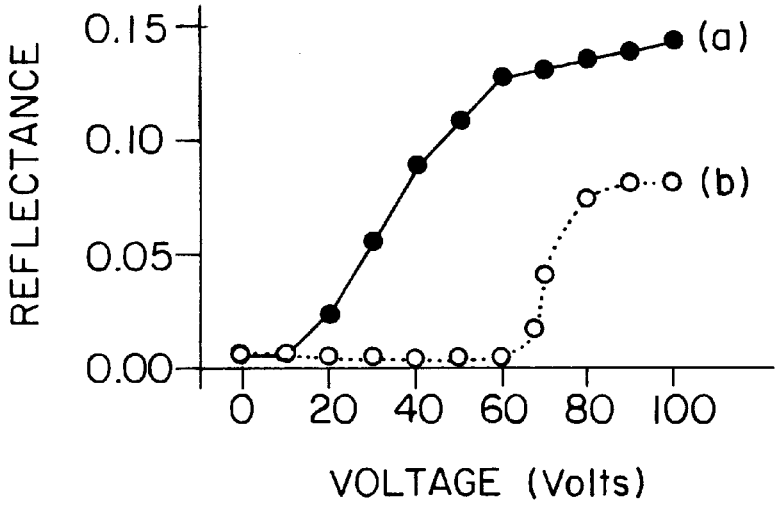
FIG. 5 is a graphical representation of the response to voltage pulses of a dual frequency cholesteric material initially in a focal conic texture.

In FIGS. 4 and 5,250 millisecond pulses of the AC square wave were used. Of course, other types of pulse waves could be employed. The high frequency pulse had a frequency of 10 kHz and a low frequency pulse had a frequency of 200 Hz. Before application of the pulses, the material was either refreshed to the planar texture or the focal conic texture. In these figures, the reflectance was measured 2 seconds after removal of the pulse when the reflectance did not change any more with time.

As seen in FIG. 4, curve (a) shows the result for the high frequency voltage pulses. The material remained in the planar texture and the reflectance remained high. Curve (b) shows the result for the low frequency pulses. The material remained in the planar texture with high reflectance for pulses with voltage below 30V. Above 30V, when the voltage was increased, more liquid crystal domains were switched to the focal conic texture and the reflectance decreased. When the voltage was raised to about 66V, the material was completely switched to the focal conic texture with minimum reflectance. When the voltage was increased above 66V, some domains were switched to the focal conic texture and the remaining domains were switched to the homeotropic texture during the pulse and relaxed to the planar texture after the pulse. Accordingly, the reflectance increased again. When the voltage was higher than 72V, all the domains were switched to the homeotropic texture and relaxed back to the planar texture after the pulse. The reflectance was high but still lower than that of the initial planar texture. It is theorized that this was a result of there being more defects in the planar texture obtained by the relaxation from the homeotropic texture.

FIG. 5 presents the instance where the material is initially refreshed to the focal conic texture. Curve (a) in FIG. 5 shows the high frequency pulses and curve (b) shows the low frequency pulses. For curve (a), as the voltage was increased, more and more domains were switched to the planar texture and the reflectance increased. The voltage needed to switch the material completely from the focal conic texture to the planar texture was about 100V. For the low frequency pulses, curve (b), the material remained in the focal conic texture with the minimum reflectance when the voltage was below 60V. When the voltage was increased above 60V, more and more domains were switched to the homeotropic texture during the pulse and relaxed to the planar texture after the pulse. Accordingly, the reflectance of the cell increased.

The drive scheme controls the reflectance at each pixel by controlling the voltage amplitude and/or frequency at each pixel. The voltage at the pixel or pixel voltage is the difference between the voltage applied on one of the first plurality of electrodes and the voltage applied on one of the second plurality of electrodes. The pixel voltage is represented by the following equation:

$$\text{Pixel voltage}=V_1-V_2$$

Where $V_1$ is a voltage on the first plurality of electrodes and $V_2$ is the voltage on the second plurality of electrodes. In generating the pixel voltage, the drive scheme applies either a low frequency voltage $V_L$ or a high frequency voltage $V_H$, respectively, at each electrode. $V_L$ and $V_H$ could be in the form of square, sine, triangular waves or the like. The values of $V_L$ and $V_H$ and their frequencies depend on the cell structure and materials used therein. Incorporating these voltage values into the pixel voltage equation results in the following exemplary equation:

$$\text{Pixel voltage}=(V_L+V_H)_1-(V_L+V_H)_2$$

Changes in polarity are represented as changes in sign, either plus or minus, for each respective voltage. The drive scheme changes polarity to achieve the proper pixel voltage and obtain the desired reflectance at the pixels.

Figure 6:
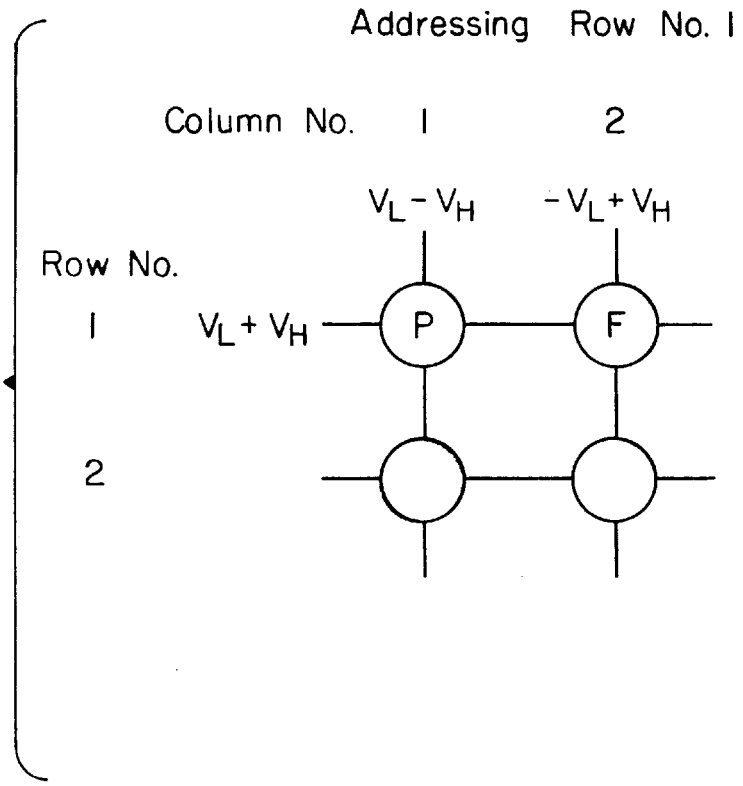
FIG. 6 is a schematic diagram of a display for the dual frequency cholesteric display where row 1 is addressed.
Figure 7:
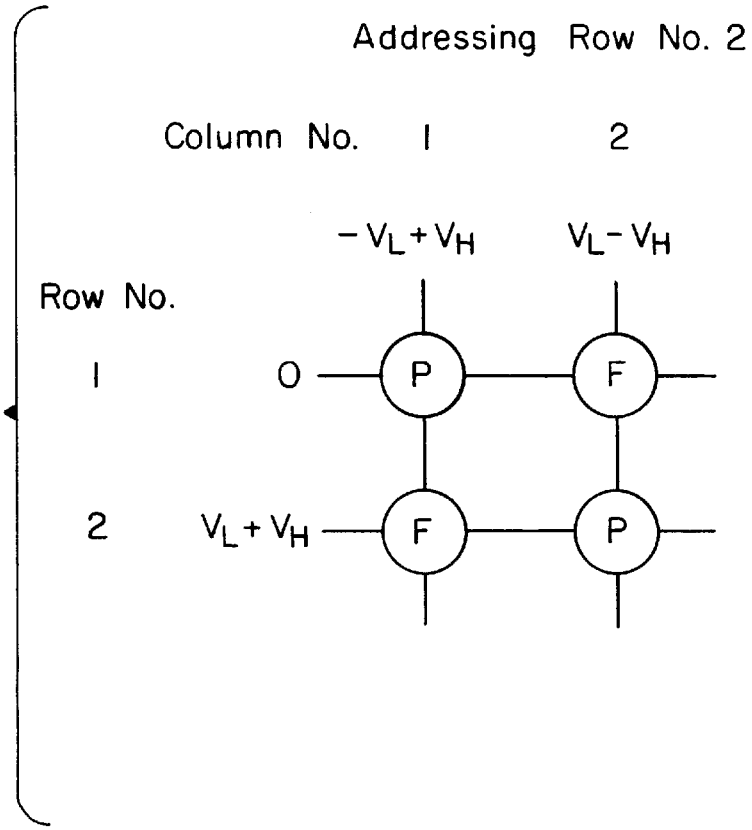
FIG. 7 is a schematic diagram of a display for the dual frequency cholesteric display where row 2 is addressed.

FIGS. 6 and 7 provide a schematic representation of the pixels and demonstrate how the drive scheme controls the pixel voltage. The drive scheme achieves control by choosing first electrode voltages and second electrode voltages to produce the proper reflectance at the pixel. The scheme simultaneously applies a low frequency and high frequency voltage or no voltage across these electrodes. These applied voltages combine to form the pixel voltage. This combination results in a number of possible effects. For example, the effects of the high frequency voltages applied across the first plurality and second plurality of electrodes may cancel each other leaving a low frequency pixel voltage. In the alternative, the effects of the low frequency voltages from the opposing electrodes could cancel one another producing a high frequency voltage at the pixel. In some cases, the effects of the low and high frequency voltages combine at the pixel and the pixel sees both a high frequency and low frequency voltage. These high and low frequency components effectively nullify each other leaving the liquid crystal material at its original state. Finally, where zero or minimal voltage is applied to one electrode, the other electrode, solely, determines the pixel voltage.

In FIGS. 6 and 7, the first and second electrodes are designated as columns and rows respectively. FIG. 6 schematically shows a scheme for addressing row 1. When addressing row 1, the pixel voltage across pixel 1,1 is represented by the following equation:

$$V_{11}=V_{R1}-V_{C1}=(V_L+V_H)_{R1}-(V_L-V_H)_{C1}=2V_H$$

Here, the low frequency voltage from row 1 and column 1 cancel each other. Thus, the high frequency voltage drives the liquid crystal material into a planar texture as designated by the capital P.

The pixel voltage at pixel 1,2 is:

$$V_{12}=V_{R1}-V_{C2}=(V_L+V_H)_{R1}-(-V_L+V_H)_{C2}=2V_L$$

At pixel 1,2, the resulting pixel voltage is a low frequency voltage. More specifically, a low frequency and negatively polarized high frequency are applied to column 1 with a positive low frequency and high frequency voltage applied to row 1. As a result, the drive scheme switches pixel 1,2 to the focal conic texture by effectively applying a low frequency voltage across the electrodes. Thus, a planar texture material may be driven directly to the focal conic texture.

In FIG. 7, row 2 is addressed. The drive scheme holds pixel 1,1 and pixel 1,2 in state. To accomplish this effect, voltages are chosen so that their aligning effects on the liquid crystal material cancel each other leaving the crystal at state. The drive scheme accomplishes this by applying a minimal or zero or minimal voltage on at least one electrode. Here, the drive scheme applies zero or a minimal voltage on row 1, and a negative low frequency voltage and a positive high frequency voltage on column 1 holding the pixel at state. The equation representing this is:

$$V_{11}=V_{R1}-V_{C1}=0-(-V_L+V_H)=(V_L-V_H)$$

The high frequency pulse and low frequency pulse effects cancel each other, and the pixel remains at state. Similarly, the voltage on pixel 1,2 is:

$$V_{12}=V_{R1}-V_{C2}=0-(V_L-V_H)=(-V_L+V_H)$$

Again, the frequency effects of the high frequency pulse and low frequency pulse cancel each other and the pixel remains at state.

At pixel 2,2 the voltage is:

$$V_{22}=V_{R2}-V_{C2}=(V_L+V_H)-(V_L-V_H)=2V_H$$

The pixel 2,2 is switched to the planar texture. The voltage across pixel 2,1 is:

$$V_{21}=V_{R2}-V_{C1}=(V_L+V_H)-(-V_L+V_H)=2V_L$$

Thus, pixel 2,1 is switched to the focal conic texture.

The drive scheme produces the desired reflectance by choosing the amplitude, frequency, and polarity on each plurality of electrodes, and applying these to the electrodes. In this manner, the drive scheme produces a pixel voltage causing the liquid crystal material to assume or remain at the desired texture and reflectance. A background or base voltage may be applied simultaneously to the row and column electrode which in turn does not produce a pixel voltage. Furthermore, the cumulative effect can be used, such that application of multiple pulses allows the liquid crystal material to switch between textures step by step corresponding to the number of pulses applied. Accordingly, the amplitude and/or the duration of the pulses can be reduced, thus increasing the speed in which the display is addressed and the image produced.

The advantages of the present invention are readily apparent. Primarily, the present invention allows for quasi-video rate cholesteric displays. This is accomplished by controlling the polarity, the frequency and/or amplitude of voltage applied to the electrodes. This fully utilizes the direct transition from the planar texture to the focal conic texture or vice versa. In other words, the material does not need to be driven from one state or texture to another by one long pulse. The present invention allows the use of short pulses to incrementally achieve the desired reflectance.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of true scope and breadth of the invention, reference should be made to the following claims.

What is claimed is:

1. A method of addressing a dual frequency bistable cholesteric liquid crystal material having liquid crystal domains disposed between opposed substrates, wherein one of the substrates has a first plurality of electrodes facing a second plurality of electrodes on the other substrate, and wherein the intersection of the first and the second plurality of electrodes forms a plurality of pixels, the method comprising the steps of:

selectively applying high and low frequency voltages to said plurality of pixels, wherein the high frequency voltage drives the material to exhibit one texture so that the liquid crystal domains have a reflectance at one extreme and the low frequency voltage drives the material to exhibit another texture so that the liquid crystal domains have a reflectance at another extreme, wherein the liquid crystal domains are stable after removal of the voltages;

adjusting a voltage amplitude value for each said high and low frequency to obtain a desired reflectance which can be at either extreme or somewhere between the two extremes, wherein said desired reflectance is made up of pixels, each said pixel having a first portion of liquid crystal domains at one extreme and another portion of liquid crystal domains at the other extreme; and cumulatively adjusting the desired reflectance by simultaneously applying said high and low frequency voltages in multiple pulses such that switching of the liquid crystal domains is accomplished cumulatively so that the amplitude or the duration of the pulses, or both can be reduced.

2. The method according to claim 1 wherein the step of selectively applying further comprises the step of simultaneously applying said high and low frequency voltages.

3. The method according to claim 2 wherein the high frequency is about 10 Kilohertz.

4. The method according to claim 2 wherein the low frequency voltage is about 200 Hertz.

5. The method according to claim 2, further comprising the steps of:

applying both a high and low frequency voltage to said first plurality of electrodes and a high and low frequency voltage to said second plurality of electrodes; and adjusting the polarity of said high and low frequency voltages applied to drive the material to the one or the other texture.

6. The method according to claim 5, further comprising the step of:

canceling the high frequency voltages applied to a pixel so that only low frequency voltages remain to drive the material to exhibit the other texture.

7. The method according to claim 5, further comprising the step of:

canceling the low frequency voltages applied to a pixel so that only the high frequency voltages remain to drive the material to exhibit the one texture.

8. The method according to claim 2 further comprising the step of:

applying a high and low frequency voltage to one of said plurality of electrodes and a minimal voltage to said other plurality of electrodes, wherein said high and low frequency voltage values nullify each other and said corresponding pixel maintains its texture.

9. The method according to claim 2, wherein application of a higher frequency voltage value to said pixel increases the reflectance of said pixel.

10. The method according to claim 2, wherein application of a lower frequency voltage value to said pixel decreases the reflectance of said pixel.

11. A dual frequency cholesteric display, comprising:

a pair of opposed substrates, wherein one of said substrates has a first plurality of electrodes facing a second plurality of electrodes on the other substrate;

a reflective dual frequency bistable cholesteric liquid crystal material disposed between said substrates, wherein the material and the intersection of the first and second plurality of electrodes forms a plurality of pixels, said material having liquid crystal domains, wherein a plurality of said liquid crystal domains are contained in each of said pixels such that all the liquid crystal domains in a pixel can be either in a focal conic or a planar texture, or the liquid crystal domains in a pixel can have any combination of focal conic and planar textures;

means for selectively applying high and low frequency voltages to said plurality of pixels, wherein the high frequency voltage drives the material to exhibit predominantly one texture and the low frequency voltage drives the material to exhibit predominantly another texture;

means for adjusting a voltage amplitude value for each said high and low frequency to obtain a desired reflectance for each pixel, wherein adjusting the voltage amplitude drives the liquid crystal domains in a corresponding manner so as to change the proportion of liquid crystal domains in each texture; and means for cumulatively adjusting the reflectance by simultaneously applying high and low frequency voltage pulses to both said plurality of electrodes, wherein cumulatively switching of the liquid crystal domains between textures is accomplished by multiple pulses so that the amplitude or the duration of the pulses, or both can be reduced.

12. The display according to claim 11, wherein said means for selectively applying further comprises means for simultaneously applying said high and low frequency voltages.

13. The display according to claim 12, wherein the high frequency is about 10 kilohertz.

14. The display according to claim 12, wherein the low frequency is about 200 hertz.

15. The display according to claim 12, wherein said means for selectively applying further comprises:

means for applying both a high and low frequency voltage to said first plurality of electrodes and a high and low frequency voltage to said second plurality of electrodes; and means for adjusting the polarity of said high and low frequency voltages applied to drive the material to the one or the other texture.

16. The display according to claim 15, wherein said means for selectively applying further comprises:

means for canceling the high frequency voltages applied to a pixel so that only low frequency voltages remain to drive the material to exhibit the other texture.

17. The display according to claim 15, wherein said means for selectively applying further comprises:

means for canceling the low frequency voltages applied to a pixel so that only the high frequency voltages remain to drive the material to exhibit the one texture.

18. The display according to claim 12, wherein said means for selectively applying further comprises:

means for applying a high and low frequency voltage to one of said plurality of electrodes and a minimal voltage to said other plurality of electrodes, wherein said high and low frequency voltage values nullify each other and said corresponding pixel maintains its texture.

19. The display according to claim 12, wherein application of a higher frequency voltage value to said pixel increases reflectance of said pixel.

20. The display according to claim 12, wherein application of a lower frequency voltage value to said pixel decreases the reflectance of said pixel.

21. A method of addressing a dual frequency bistable cholesteric liquid crystal material having liquid crystal domains disposed between opposed substrates, wherein one of the substrates has a first plurality of electrodes facing a second plurality of electrodes on the other substrate, and wherein the intersection of the first and the second plurality of electrodes forms a plurality of pixels, the method comprising the steps of:

selectively applying high and low frequency voltages to said plurality of pixels, wherein the high frequency voltage drives the material to exhibit one texture so that the liquid crystal domains have a reflectance at one extreme and the low frequency voltage drives the material to exhibit another texture so that the liquid crystal domains have a reflectance at another extreme, wherein the liquid crystal domains are stable after removal of the voltages; and adjusting a voltage amplitude value for each said high and low frequency to obtain a desired reflectance which can be at either extreme or somewhere between the two extremes, wherein said desired reflectance is made up of pixels, each said pixel having a first portion of liquid crystal domains at one extreme and another portion of liquid crystal domains at the other extreme.

22. A dual frequency cholesteric display, comprising:

a pair of opposed substrates, wherein one of said substrates has a first plurality of electrodes facing a second plurality of electrodes on the other substrate;

a reflective dual frequency bistable cholesteric liquid crystal material disposed between said substrates, wherein the material and the intersection of the first and second plurality of electrodes forms a plurality of pixels, said material having liquid crystal domains, wherein a plurality of said liquid crystal domains are contained in each of said pixels such that all the liquid crystal domains in a pixel can be either in a focal conic or a planar texture, or the liquid crystal domains in a pixel can have any combination of focal conic and planar textures;

means for selectively applying high and low frequency voltages to said plurality of pixels, wherein the high frequency voltage drives the material to exhibit predominantly one texture and the low frequency voltage drives the material to exhibit predominantly another texture; and means for adjusting a voltage amplitude value for each said high and low frequency to obtain a desired reflectance for each pixel, wherein adjusting the voltage amplitude drives the liquid crystal domains in a corresponding manner so as to change the proportion of liquid crystal domains in each texture.

* * * * *